US010363191B2

(12) United States Patent
Pölönen et al.

(10) Patent No.: US 10,363,191 B2
(45) Date of Patent: Jul. 30, 2019

(54) MULTIFUNCTIONAL CURVED BOARD

(71) Applicant: Gymba Oy, Joensuu (FI)

(72) Inventors: Jarmo Pölönen, Joensuu (FI); Heikki Koivurova, Ylämylly (FI)

(73) Assignee: Gymba Oy, Joensuu (FI)

( * ) Notice: Subject to any disclaimer, the term of this patent is extended or adjusted under 35 U.S.C. 154(b) by 23 days.

(21) Appl. No.: 15/512,080

(22) PCT Filed: Sep. 14, 2015

(86) PCT No.: PCT/FI2015/050607
§ 371 (c)(1),
(2) Date: Mar. 17, 2017

(87) PCT Pub. No.: WO2016/046450
PCT Pub. Date: Mar. 31, 2016

(65) Prior Publication Data

US 2017/0273848 A1 Sep. 28, 2017

(30) Foreign Application Priority Data

Sep. 25, 2014 (FI) ..... 20140119 U
Dec. 12, 2014 (FI) ..... 20146084

(51) Int. Cl.
*A61H 1/00* (2006.01)
*A63B 21/00* (2006.01)
(Continued)

(52) U.S. Cl.
CPC ..... *A61H 1/003* (2013.01); *A61H 1/005* (2013.01); *A63B 21/4035* (2015.10);
(Continued)

(58) Field of Classification Search
CPC ..... A63B 22/16; A63B 21/00058; A63B 21/00069; A63B 21/00072; A63B 21/00076; A63B 21/00185; A63B 21/00189; A63B 21/02; A63B 21/026; A63B 21/04; A63B 21/0407; A63B 21/0414; A63B 21/0421; A63B 21/0428; A63B 21/0435; A63B 21/0442;
(Continued)

(56) References Cited

U.S. PATENT DOCUMENTS 5,152,691 A * 10/1992 Moscarello ..... A63B 22/16 434/247
5,496,248 A 3/1996 Batscher
(Continued)

FOREIGN PATENT DOCUMENTS

DE 29603880 U1 4/1996
EM 002379677-0001 M 3/2014
(Continued)

*Primary Examiner* — Gary D Urbiel Goldner
(74) *Attorney, Agent, or Firm* — Seppo Laine Oy

(57) ABSTRACT

A multi-functional curved board used as a support for legs of a user and for general maintenance of muscle strength, the multi-functional curved board having one or more curved bodies (1) including a radius of curvature, a longitudinal axis, and at least one raised foot support. The multi-functional curved board can be bent in the direction transverse to the radius of curvature to enable the multi-functional curved board to rotate around the longitudinal axis.

12 Claims, 9 Drawing Sheets

(51) Int. Cl.

| | |
|---|---|
| ***A63B 22/14*** | (2006.01) |
| ***A63B 22/16*** | (2006.01) |
| ***A63B 22/20*** | (2006.01) |
| ***A63B 23/04*** | (2006.01) |
| ***A63B 26/00*** | (2006.01) |
| ***A63B 23/02*** | (2006.01) |
| ***A63B 23/12*** | (2006.01) |
| ***A63B 23/00*** | (2006.01) |
| ***A63B 71/00*** | (2006.01) |

(52) U.S. Cl.
CPC ..... *A63B 22/14* (2013.01); *A63B 22/16* (2013.01); *A63B 22/20* (2013.01); *A63B 23/0405* (2013.01); *A63B 23/0458* (2013.01); *A63B 26/003* (2013.01); *A63B 23/0211* (2013.01); *A63B 23/0227* (2013.01); *A63B 23/1236* (2013.01); *A63B 2023/003* (2013.01); *A63B 2023/006* (2013.01); *A63B 2071/0063* (2013.01); *A63B 2208/0204* (2013.01); *A63B 2208/0233* (2013.01); *A63B 2208/0242* (2013.01)

(58) Field of Classification Search
CPC ..... A63B 21/045; A63B 21/0455; A63B 21/0615; A63B 21/0616; A63B 21/0617; A63B 21/068; A63B 21/15; A63B 21/159; A63B 21/4023; A63B 21/4027; A63B 21/4033; A63B 21/4034; A63B 21/4035; A63B 21/4039; A63B 21/4043; A63B 21/4049; A63B 22/0015; A63B 22/0017; A63B 22/0046; A63B 22/14; A63B 22/18; A63B 22/20; A63B 22/201; A63B 22/203; A63B 22/205; A63B 22/208; A63B 2022/0092; A63B 2022/206; A63B 23/02; A63B 23/0205; A63B 23/0211; A63B 23/0216; A63B 23/0222; A63B 23/035; A63B 23/03516; A63B 23/03525; A63B 23/0355; A63B 23/04; A63B 23/0405; A63B 23/0458; A63B 23/0464; A63B 23/0482; A63B 23/0488; A63B 23/0494; A63B 23/12; A63B 23/1209; A63B 23/1236; A63B 23/1245; A63B 23/1281; A63B 2023/003; A63B 2023/006; A63B 2023/0411; A63B 26/00; A63B 26/003; A63B 71/0054; A63B 2071/0063; A63B 2071/0072; A63B 2208/0204; A63B 2208/0228; A63B 2208/0233; A63B 2208/0295; A63B 2225/09; A63B 2225/093; A61H 1/003; A61H 1/005
See application file for complete search history.

(56) References Cited

U.S. PATENT DOCUMENTS

| | | | | |
|---|---|---|---|---|
| 5,562,575 | A * | 10/1996 | Gvoich | A63B 5/08 482/26 |
| 5,643,164 | A | 7/1997 | Teff | |
| 7,563,216 | B1 | 7/2009 | Kest | |
| D736,549 | S * | 8/2015 | Andersen | A63B 5/08 D6/685 |
| 2011/0269605 | A1 | 11/2011 | Kim et al. | |
| 2011/0316319 | A1 | 12/2011 | Lukic et al. | |
| 2014/0228187 | A1 * | 8/2014 | Moscarello | A63B 26/003 482/142 |

FOREIGN PATENT DOCUMENTS

| | | | |
|---|---|---|---|
| EP | 1245252 | A2 | 10/2002 |
| GB | 2370998 | A | 7/2002 |
| JP | 2003225326 | A | 8/2003 |
| WO | WO2008153986 | A1 | 12/2008 |

* cited by examiner

MULTIFUNCTIONAL CURVED BOARD

FIELD OF THE INVENTION

The present invention relates to a multi-functional curved board according to the preamble of claim 1.

BACKGROUND OF THE INVENTION

A number of studies show that a large number of people are physically too passive for maintaining their health. One considerable reason of the passivity is excessive sitting. Office workers sit in chairs by their office desks many hours a day. The workers should occasionally stand up to work. Almost all new desks have a provision for height adjustment. Not many do use this feature for doing their work standing up, because standing still on a hard floor feels difficult and will stress legs and back. E.g. padded carpets have been introduced to the market to address this issue. They do make standing somewhat easier, but legs do still not move and standing still will soon cause the muscles to go numb.

One solution is a slightly curved board e.g. under product name Active Stand. This product allows some movement for legs and numbing can be reduced. A disadvantage of this evenly curved board is that standing on the curved surface causes the joints of ankles and knees to bend to a wrong position. A longer period of standing on a curved surface can cause stress problems to especially those having previous issues with ankle and knee joints. When rocking the board, the bending increases and the issue gets worse. The issue is further emphasized, if conventional, unstable level-surfaced balance boards with rocking movement in all directions are used. The disadvantage of the current curved rigid board is the rigidity of the board also causing the above-mentioned even tension in legs and the muscles above legs. It is possible to vary the points of tension by rocking the board but during rocking it is nearly impossible to e.g. use the keyboard, whereby work is interrupted during the rocking, thus causing a lower work efficiency.

PURPOSE OF THE INVENTION

The purpose of the invention is to act as a means for improving the health and well-being of people and for reducing physical passivity, for increasing exercise and muscle strength as well as for improving balance. The invention is suitable for use in e.g. offices, at home and in physical exercise groups as well as care and rehabilitation units. The purpose of the various embodiments of this invention is to provide a multi-functional curved board allowing exercising a number of muscle groups, training balance as well as stretching the body in many ways during work as well as between work. The purpose is further to provide a flexible multi-functional curved board, whereby an even tension is avoided in e.g. when working in the standing position. The purpose is to be able to change the elastic properties of the multi-functional curved board. The purpose is to be able to add add-on parts to the board whereby the flexibility properties and the direction of flexibility of the multi-functional curved board can be changed.

SHORT DESCRIPTION OF THE INVENTION

The above-mentioned disadvantages can be eliminated and the purposes of the invention are achieved by means of various embodiments of the multi-functional curved board of the present invention. An especially characterizing feature of the invention is what is disclosed in the characterizing part of claim 1. Preferred embodiments of the invention are disclosed in the dependent claims.

The most important advantage is that the multi-functional curved board is implemented ergonomically so that the above-mentioned problems can be solved. The multi-functional curved board can be produced by e.g. gluing wood veneers on top of each other in a mould so as to produce a curved board.

Rocking/flexible counter-curve means, implemented e.g. by means of an articulated structure, following the rocking movement so that legs always stay in the correct, natural position, can be attached at the ends of the body board, below the feet and inside the curve of the body plate. The rocking means can be implemented also by other means, such as by using steel or rubber springs. The disadvantage of this implementation is that the structure is rather complex and expensive. A simple and inexpensive way to solve the problem is to produce a curved board into which so-called counter-curve pieces (counter-curve means) are attached into the concave side (inner surface of the curve of the body) to the ends of the board, under the feet or the counter-curved shape exists in the curved board already when the product is made in a mold or e.g. by means of CNC machining technology. These separate counter-curve pieces can be produced using known methods and suitable materials and they can be attached to the curved board by gluing or screwing or with other suitable known method.

When one stands on the board, on the counter-curve shape, the feet will automatically find a correct and natural position. During rocking the feet turn effortlessly to the correct position due to the curved shape.

The ergonomically shaped curved board described above can most preferably be produced by means of a molding technology by rotation molding, blow molding of plastic or injection molding from plastic or from a composite material or with other known molding technology. The advantage of a product produced from a composite material by injection molding is its eco-friendliness and cost-effectiveness of production. It is also an advantage that the rigidity, elasticity and strength of the product are easy to adjust by changing the composition of the plastic or composite material. A suitable flexibility of the curved board also improves standing comfort and therefore it is useful to produce the product so as to suit different weight classes.

An ergonomically shaped curved board can also be produced from suitable materials, such as wood, composite or plastic by means of CNC machining technology.

It is useful to attach a suitable coating on the convex side (outer side of the curve) for avoiding scratching of the floor when the convex side is against the floor. The coating must also be such that the piece does not easily slip from under the user. The coating can be e.g. tightly compressed closed-cell foam or e.g. a felt-like mat. The coating can be attached to the product by means of e.g. stickers, by gluing or with an adhesive glue on the coating itself. The coating feels pleasant under the feet and is not slippery when the curved board is used with its convex side upwards. When the curved board is with its convex side upwards, the contact point with the floor is on a fairly small definite area of the counter-curve shape. It is useful to attach protective pieces in this place either on the whole area or on a part of the distance. The protective pieces prevent wear of the floor and the slipping of the board from under the user. The material of the protective pieces must be durable enough and the protective pieces must not leave any scratches or other signs of wear on the floor. If necessary, the protective pieces are replaceable. The protective pieces can be produced by e.g. injection molding from a suitable material. They can also be part made of felt or other suitable material that is fastened by means of e.g. stickers or gluing.

An advantage of the multi-function curved board is its versatility compared to competitors. The use is not limited to just standing on the concave side and rocking. It can be used on both sides and it can be used for a large number of various muscle strength, stretching, massage and balance exercises. The multi-functional curved board is used its concave side up, whereby it functions as an active standing platform. The user can stand with the weight evenly on both feet, whereby the body will not rock. When the weight is moved from one leg to the other, the curved board starts to rock and balancing is activated. Muscles are also woken up from rest and metabolism is activated. Moving the weight also creates movement for joints and muscles in nearly all of the body and it will also strengthen e.g. the muscles of legs, back and abdomen. The more active the rocking is, the more efficient the physical exercise will be. The user can stand up so that both legs are next to each other or so that the user stands on the board in a walking position, i.e. one foot in front and the other at the back.

The multi-functional curved board can also be used with its convex side up. The convex side is a pleasant substrate for light stepping back and forth or standing on one place. It is a good idea to every now and then stretch the calf muscles as well, and the curved board is a very good means for that. The multi-functional curved board can also be used for stretching back and side muscles by laying down on the convex side on the back or side.

The multi-functional curved board can also be used when sitting, either as a foot stool or for rocking the feet to avoid numbing. Various add-ons can be added to the multi-functional curved board for making the use of the product more versatile, such as to increase the difficulty of balancing exercises. E.g. using a hemispherical means as an accessory. The use of accessories can easily be taken into consideration in the production of multi-functional curved board by making suitable indentations into which the hemispherical means can easily be installed in various locations. The multi-functional curved board can be made a versatile and demanding balance board by placing one or more hemispherical means in the middle of the board or at various places on the convex side of the board. Depending on the location, the multi-functional curved board can be made to rock either longitudinally or in transverse direction or in every direction. By placing the hemispherical means on the convex side of the multi-function curved board the muscles of the back can be massaged spot-like, whereby the user lies on the board with their back on the hemisphere so that the hemisphere presses a certain muscle and the muscle is massaged by slightly moving the body. The hemisphere can also be used for massaging the soles of feet by suitably pressing the soles against the hemisphere. Other places of the body, such as thighs and calves, can also be massaged as described above. The hemispherical means can be produced by e.g. injection molding from a suitable material.

With resistance rubber bands as an accessory the multi-functional curved board acts as a n auxiliary means for muscle strength exercise for arms and upper torso with resistance rubbers, the multi-functional curved board being placed on the floor with the convex side up, the resistance rubber band being threaded below the curved board and the muscle strength exercise can be started.

The various embodiments produce a number of advantages and by combining the embodiments it is possible to combine these advantages and functions into one product or an embodiment of the invention.

The most important advantage of the invention is that the multi-functional curved board allows training of many muscle groups, balancing and stretching of the body in many ways when working, A further advantage is that the multi-functional curved board can be flexible, whereby even tension is avoided in e.g. when working standing up. The variability of flexibility properties of the multi-functional curved board is an advantage. It is obvious that the inventive multi-functional curved board will achieve financial savings in the maintenance of people's health.

LIST OF FIGURES

In the following, the invention is described in more detail with reference to the appended figures.

DETAILED DESCRIPTION OF THE INVENTION

Figure 1:
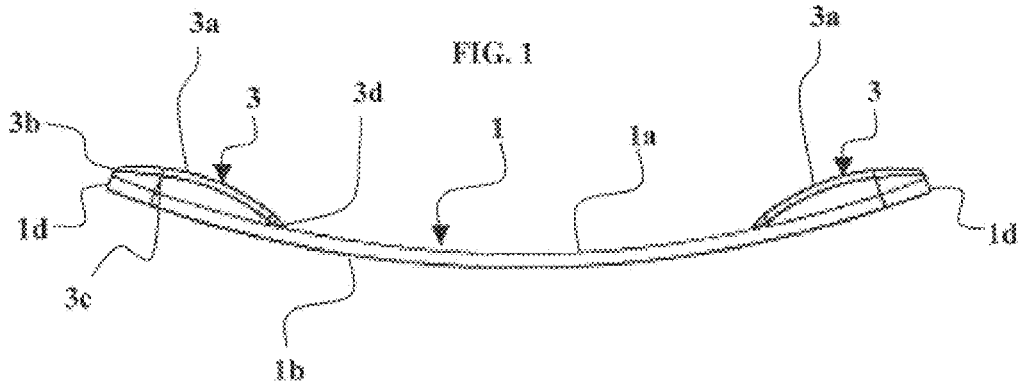
FIG. 1 illustrates a multi-functional curved board according to the invention seen directly from the side.
Figure 2:
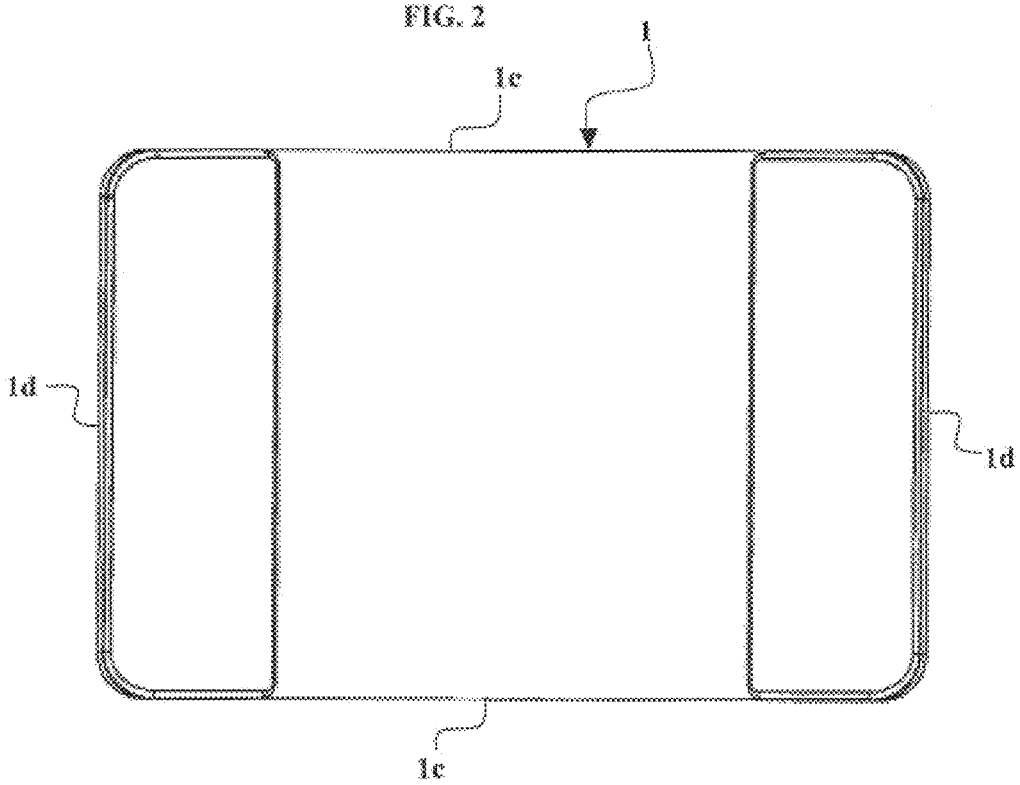
FIG. 2 illustrates the multi-functional curved board of FIG. 1 seen directly from above.
Figure 3:
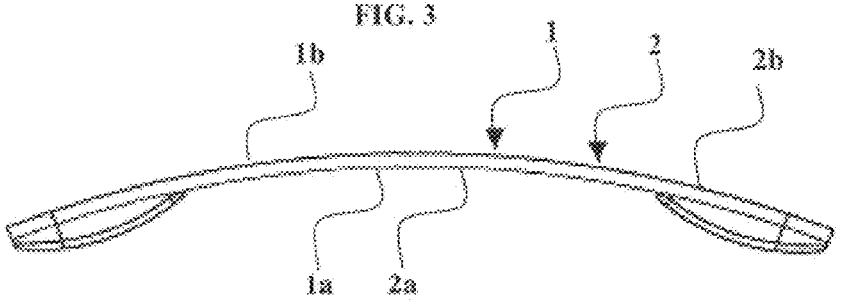
FIG. 3 illustrates the multi-functional board according to images 1 to 2, the outside surface of the board being turned upwards and seen directly from the side.
Figure 4:
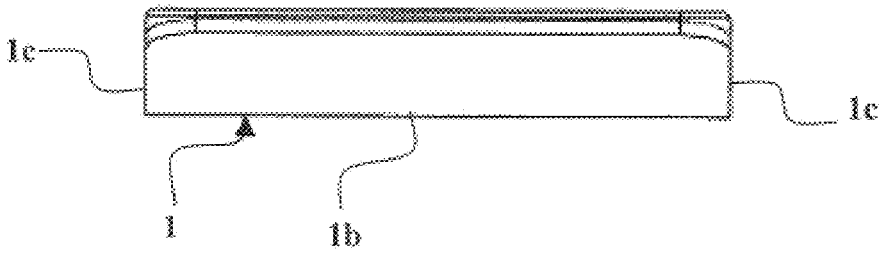
FIG. 4 illustrates the multi-functional board of FIGS. 1 to 4 seen directly from the front.
Figure 5:
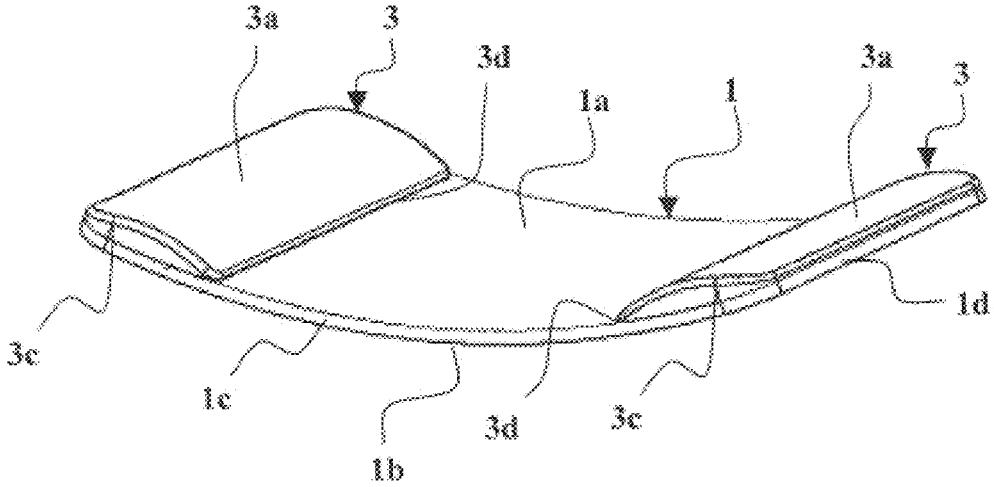
FIG. 5 illustrates the multi-functional board of FIGS. 1 to 4 seen in a side view diagonally from above.
Figure 6:
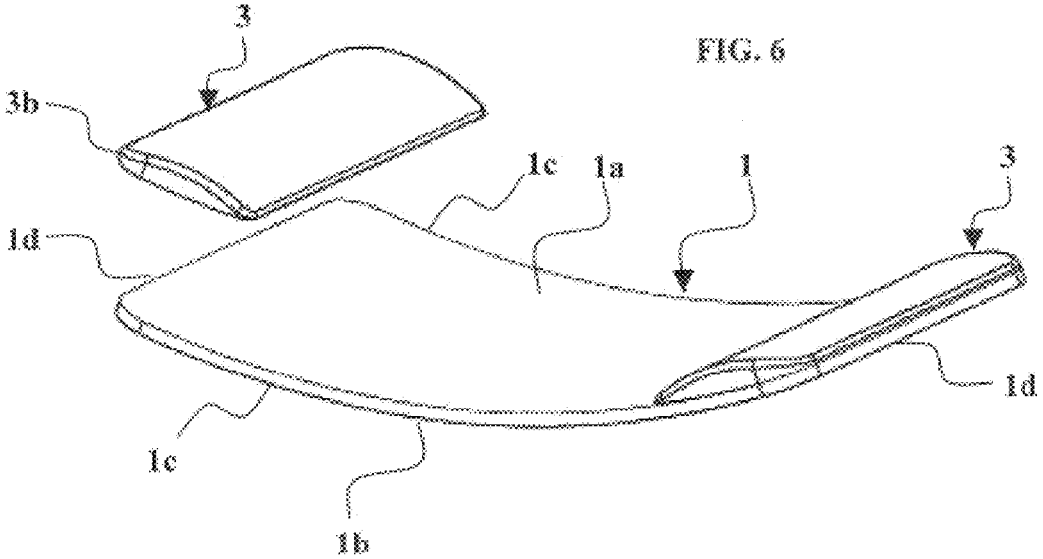
FIG. 6 illustrates the multi-functional board of FIGS. 1 to 5 in partially dismantled state seen in a side view diagonally from above.
Figure 7:
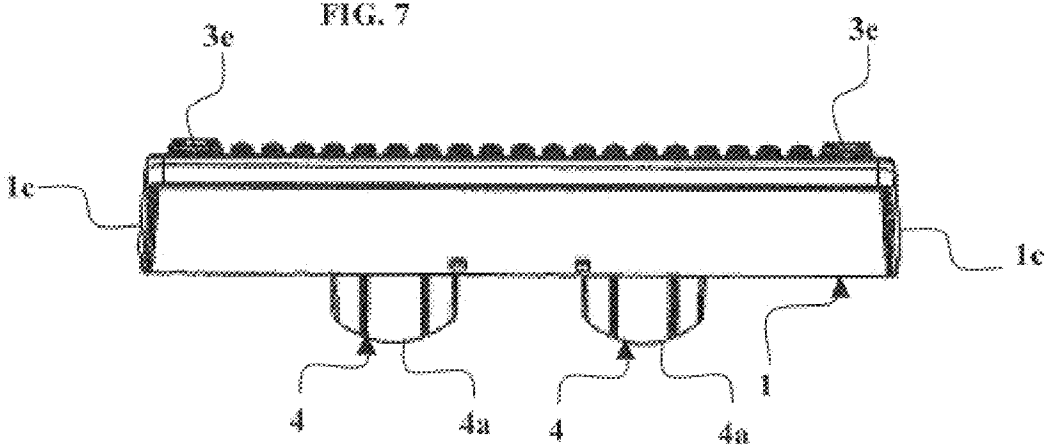
FIG. 7 illustrates another multi-functional curved board according to the invention seen directly from the front.
Figure 8:
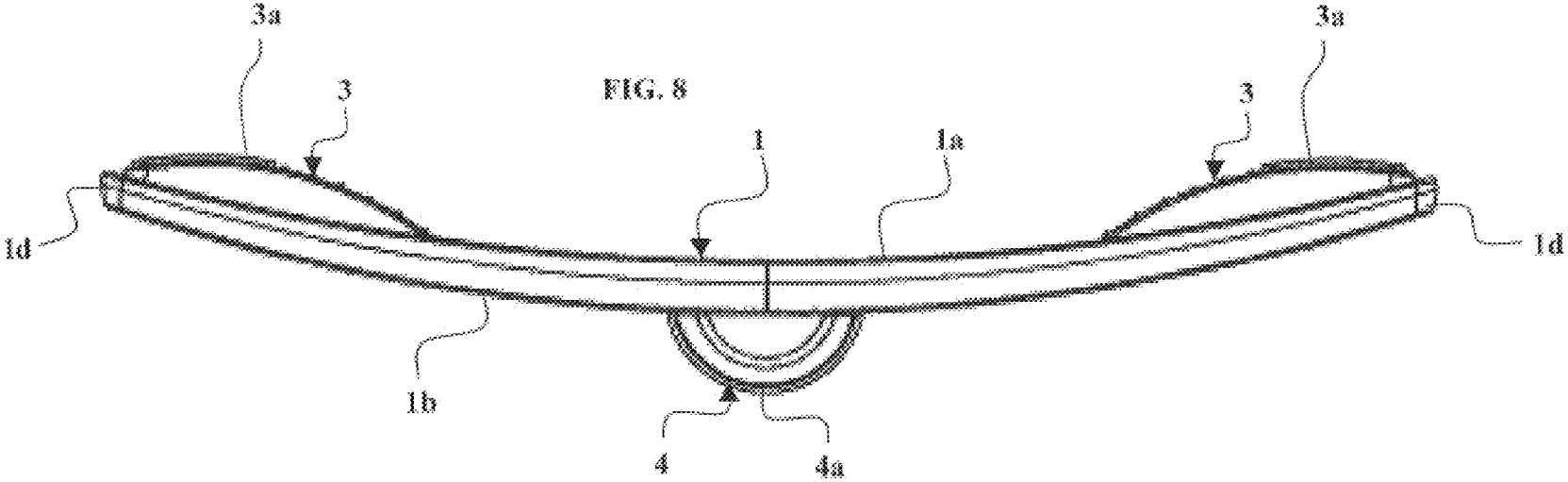
FIG. 8 illustrates a multi-functional curved board of FIG. 7 seen directly from the side.
Figure 9:
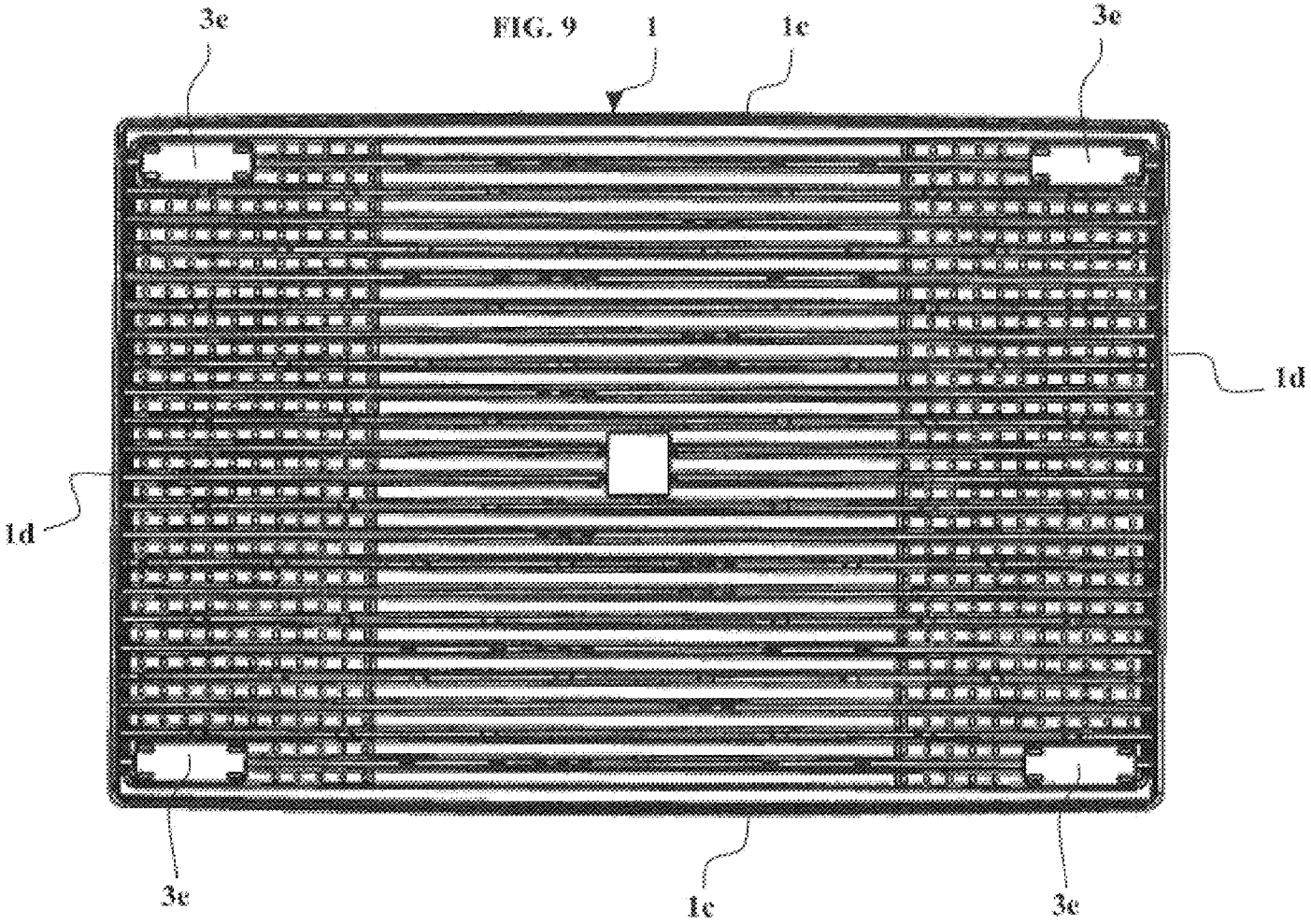
FIG. 9 illustrates a multi-functional curved board of FIGS. 7 and 8 seen directly from above.
Figure 10:
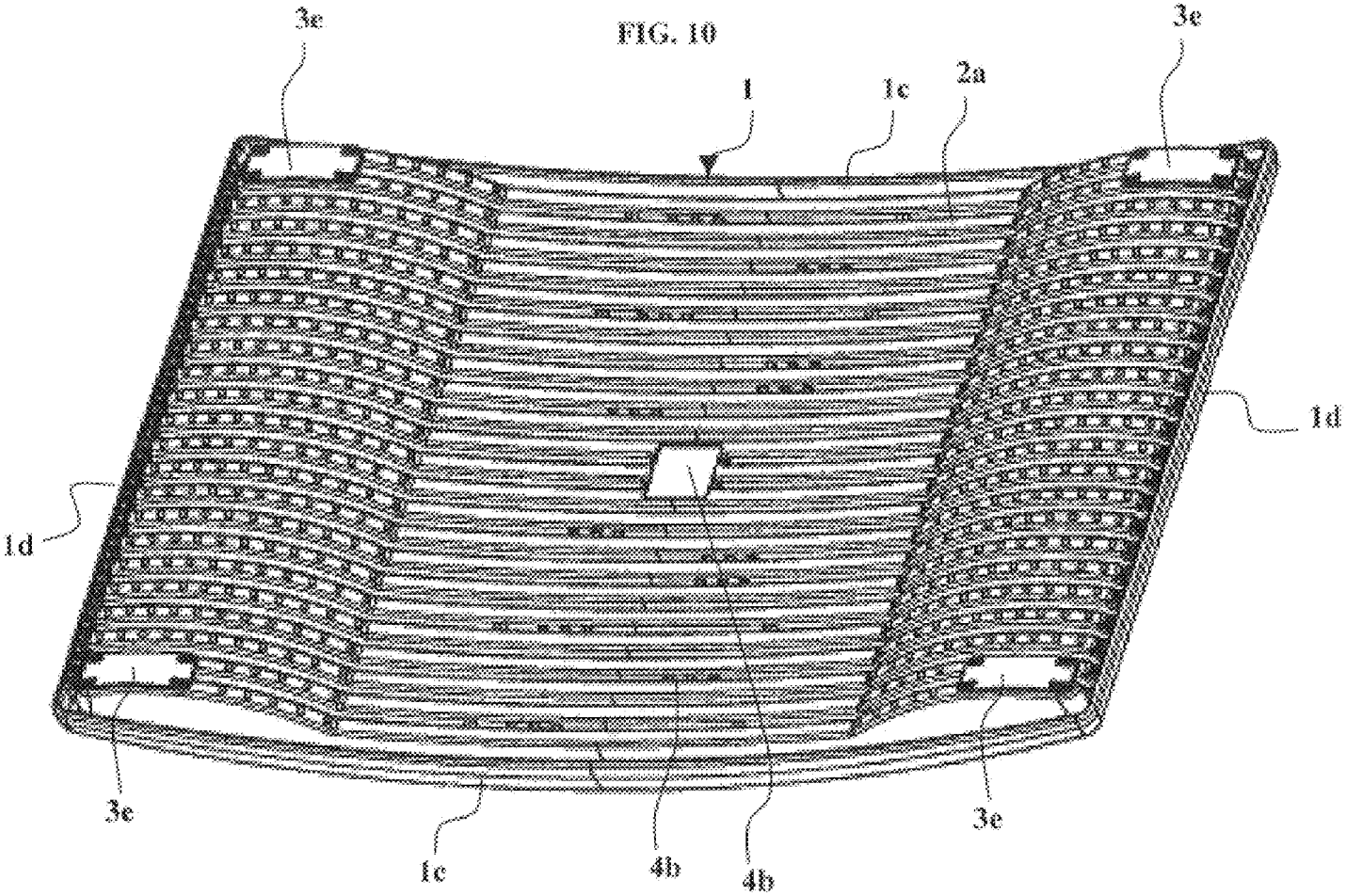
FIG. 10 illustrates the multi-functional board of FIGS. 7 to 9 seen in a side view diagonally from above.
Figure 11:
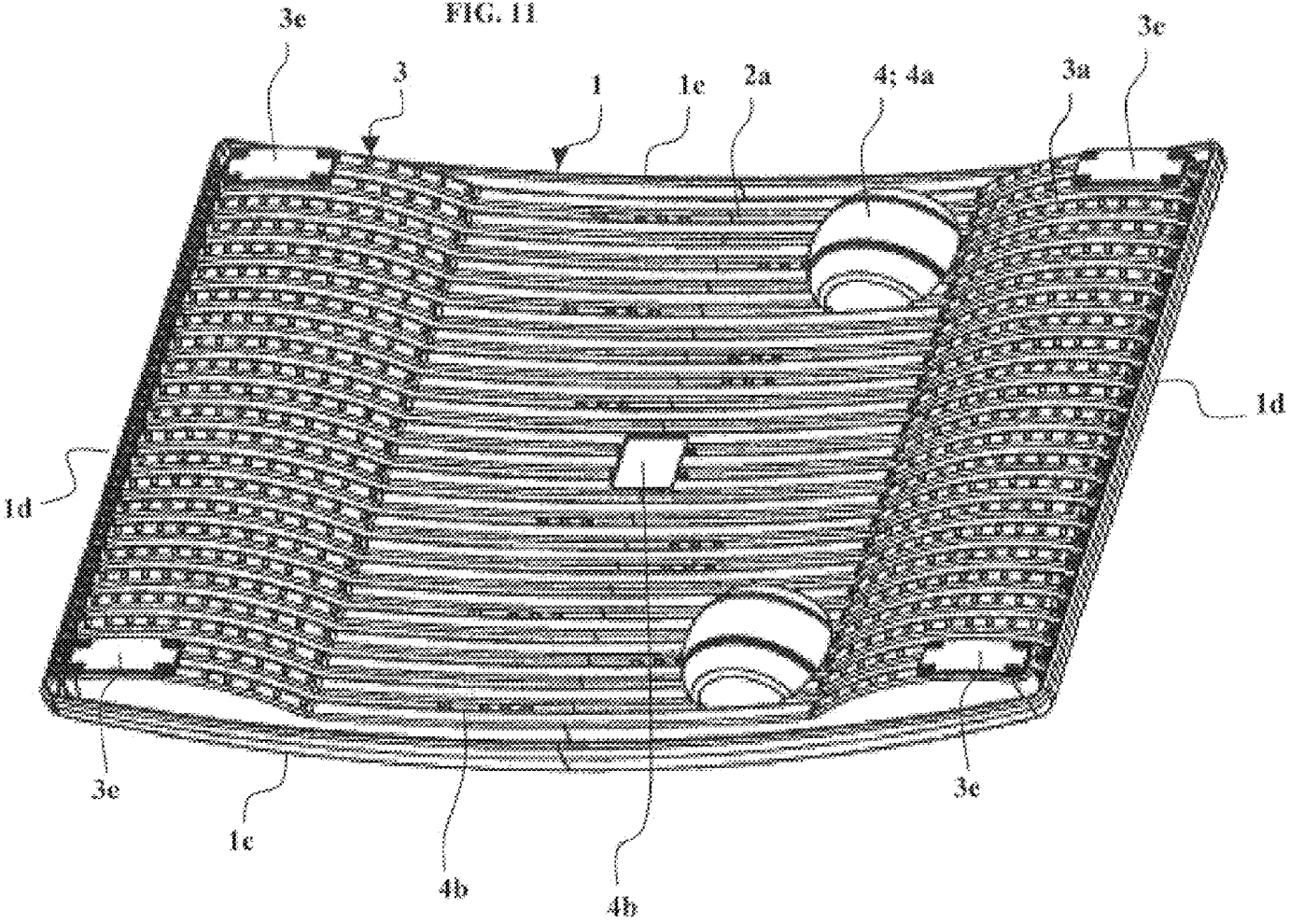
FIG. 11 illustrates the multi-functional board of FIGS. 7 to 10 seen in a side view diagonally from above.
Figure 12:
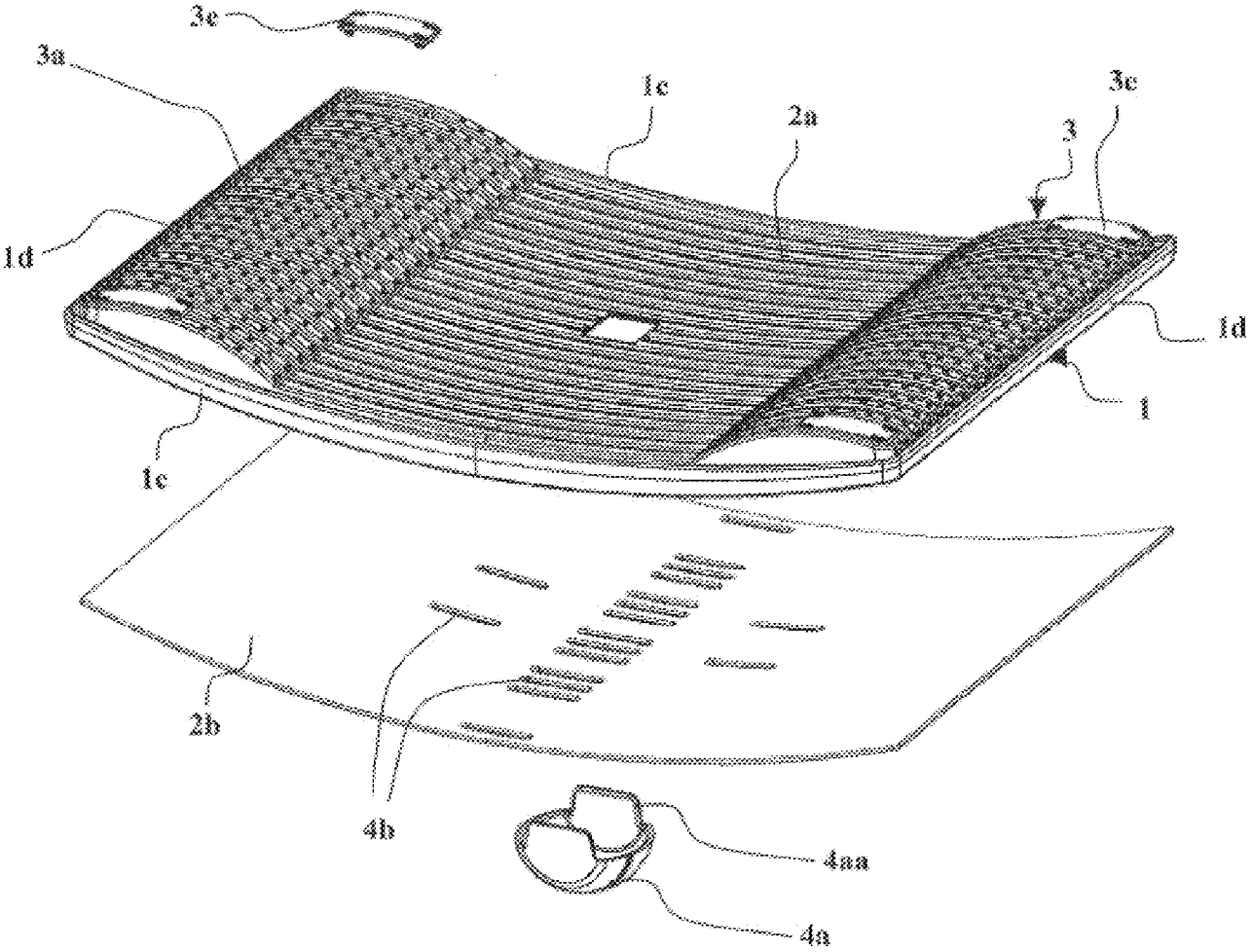
FIG. 12 illustrates the multi-functional board of FIGS. 7 to 11 in partially dismantled state seen in a side view diagonally from above.
Figure 13:
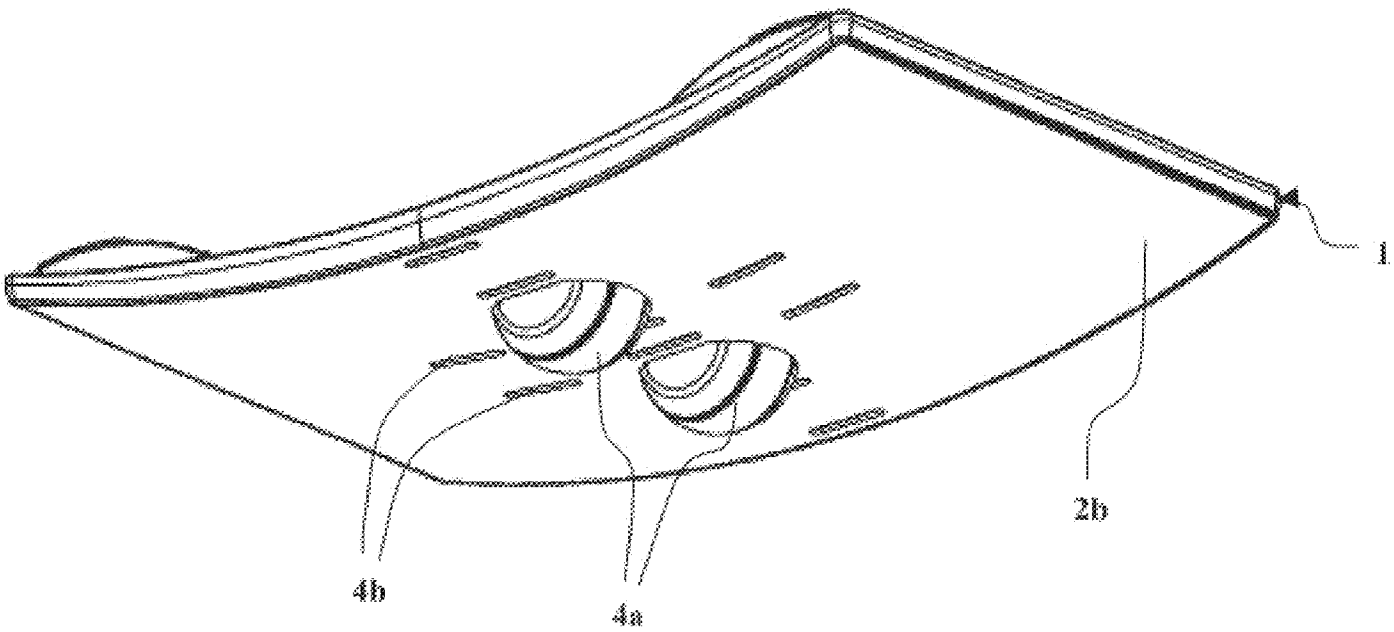
FIG. 13 illustrates the multi-functional board of FIGS. 7 to 12 seen in a side view diagonally from below.

The figures illustrate the body 1 having an curve interior surface 1*a*, an curve exterior surface 1*b*, side 1*c* and an end side 1*d*. In the figures, the body 1 is rectangular when seen from above. In side view the body is curved, wherein the curvature radius of the curve runs from the end side 1*d* to the end side 1*d*, whereby the curvature line of the body 1 is in transverse direction, i.e. it runs from the side 1*c* to the other side 1*c*. The figures show a coating 2, called according to its location the curve interior coating 2*a* and the curve exterior coating 2*b*. The curve exterior coating 2*b* can be e.g. tightly compressed closed-cell foam or e.g. a felt-like mat. The curve exterior coating 2*b* can be fastened to the body 1 by means of e.g. stickers, gluing or by using an adhesive glue on the outside curve coating 2*b* itself. The curve exterior coating 2*b* feels pleasant under the feet and it is not slippery, when the curved board is used with its convex side (curve outside 1*b*) upwards. The curve interior coating 2*a* can be of a similar material as the outside coating. The curve exterior surface 1*b* of the body 1 is curved externally and the curve interior surface 1*a* is concave.

Both ends of the body 1 are provided with a counter-curve means 3 adjacent the end side, the counter-curve means allowing a natural position of the foot when standing with feet on the counter-curve means 3. The counter-curve means 3 can be fixed or detachable in the body 1 on the curve interior surface 1*a* as shown in the figures. The upper surface of the counter-curve means 3 is the surface to stand on. This surface to stand on is formed to be convex on the outside, whereby its surface is always at right angle in relation to the sole of the foot on the upper surface 3*a* as the position of the multi-functional curved board changes in lateral direction when rocking the multi-functional curved board. The side of the counter-curve means 3 on the side of the end side 1*d* of the body 1 is the fastening side 3*b* by which the counter-curve means 3 is fastened by means of one or more fastening means 3*c*, such as a screw, to one or more end sides 1*d* of the body 1. The fastening means 3*c* can be a counter-sunk screw or other known fastener. The side opposite to the fastening side 3*b* of the counter-curve means 3 is the sliding side 3*d*. It hasn't been attached to the side of the board, but the sliding side 3*d* slides against the inner surface of the curve 1*a* of the body 1 when the user stands on the counter-curve means. The above-mentioned sliding allows springing/rocking of the counter-curve means 3. The counter-curve means 3 can be produced from other known flexible materials, e.g. the inside of the counter-curve means 3 is more flexible than the surface material.

The figures illustrate a contact point 3*e* when the body of the multi-functional curved board 1 is so that the curve external surface 1*b*, i.e. convex side is facing up. In this case the contact point 3*e* of the counter-curve means 3 is located on a certain, fairly small area of the counter-curve means 3. It is useful to attach protective pieces in the contact point 3*e* either on the whole area or on a part of the distance. The protective pieces prevent wear of the floor and slipping of the multi-functional curved board from under the user. The material of the protective pieces must be durable enough and the protective pieces must not leave any scratches or other signs of wear on the floor. The protective pieces can be replaced when needed. The protective pieces can be produced by e.g. injection molding from a suitable material. They can also be parts made of felt or other known suitable material that is fastened by means of e.g. stickers or gluing.

Various add-ons 4 can be attached to the multi-functional curved board for making the use of the product more versatile, such as for increasing the difficulty of balance training. Use of accessories/add-ons 4 can be taken into account during the production of the multi-functional curved board. For this purpose suitable indentations 4*b* are made to the body 1 of the multi-functional curved board into which the add-ons can easily be installed. E.g. the hemispherical means 4*a* can be installed by their extensions 4*aa*.

Use of the hemispherical means 4*a* as an accessory.

The multi-functional curved board can be made a versatile and demanding balance board by installing one or more hemispherical means in the middle of the board or at various places on the curved outside surface 1*b*, i.e. the convex side of the multifunction curved board. Depending on the location, the curved board can be made to rock either longitudinally or in transverse direction or in every direction. Back muscles can be massaged in a so-called point-like manner by placing the hemispherical means on the convex side of the curved board. The user lies down on their back on the board and positions themselves on the hemisphere so that the hemisphere presses on a certain muscle. The muscle is massaged by slightly moving the body. The hemisphere can also be used for massaging the soles of feet by suitably pressing the soles against the hemisphere. Other parts of the body, such as thighs and calves, can also be massaged as described above. The hemispherical means 4*a* can be made by e.g. injection molding from a suitable known material, such as plastic, wood composite, rubber and so on.

The multi-functional curved board is meant to be used when working in standing position and for working sitting down as a support for feet and generally for maintaining muscle strength, the multi-functional curved board having one or more bodies 1.

The body 1 has two or more counter-curve means 3. The counter-curve means 3 comprises an upper surface 3*a*, the surface to stand on. The upper surface of the counter-curve means 3 is curved, in longitudinal direction between the sides 1*c* the counter-curve means 3 is straight at its upper surface 3*a* like the bottom surface of a foot. Thereby the counter-curve means 3 can turn under the foot in the direction of the radius of curvature of the body 1 and the turning of the multi-functional curved board doesn't turn the foot into an angled position.

The figures show that one or more add-ons 4 can be attached to the body 1 for changing the rocking direction of the body 1. One or more add-ons 4 can be attached to the body 1 for use in targeted massage. The figures show hemispherical means 4*a*, the shape of which is hemispherical. The hemispherical means 4*a* are fastened to the body 1 by extensions 4*aa*, shown as rectangular brackets that are pushed into the above-mentioned indentations 4*b*.

The multi-functional curved board can be produced using known wood processing techniques and machines from known wood species or their combinations, such as e.g. plywood. The multi-functional curved board can be produced from plastic, composite, such as plastic-cellulose composite or other known raw material with known production technology related to said material. Thereby, when producing from plastic, it is preferable to produce the counter-curve means 3 as an integral part of the body 1.

In order to allow a small movement of feet and through them also of the whole body it is advantageous, if the foot can move and tilt in longitudinal direction as well. This is possible by means of the above-described hemispherical means or by adding to the lower surface 1*b* of the body 1*a* shape that is concave to other direction as well. The problem with this solution is that the board easily becomes too crank and work while standing up on the board is difficult. According to an embodiment of the invention the multi-functional curved board has been formed to be flexible in a direction transverse to its radius of curvature. Thereby the multi-functional curved board can turn around its longitudinal axis, i.e. the axis parallel with the radius on curvature, in relation to the longitudinal direction of the board. The edges of the multi-functional curved board can be pressed down and they can correspondingly also rise up. Thus each foot can independently turn at the ankle in a natural way in the longitudinal direction of the foot. This allows creating a small, efficient movement all the way from the foot to the pelvis and back.

Figure 14:
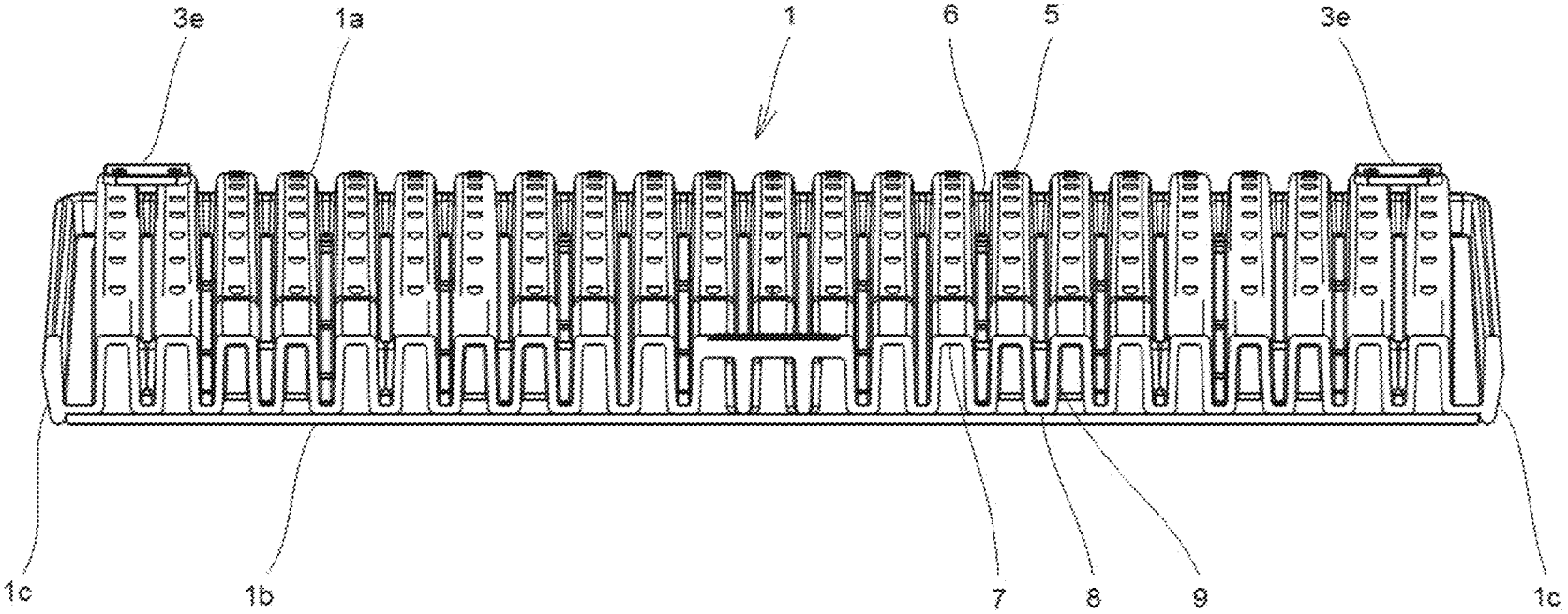
FIG. 14 illustrates a cross-section of a multi-functional curved board according to the invention.

In the above-described embodiment the body 1 of the multi-functional curved board must be sufficiently rigid in the direction of the radius of curvature in order to be able to support users of all weights without being pressed flat. On the other hand, it must be flexible in its rotation direction, i.e. transverse to the radius of curvature of the body 1. This function can preferably be carried out by means of cross-section shown in FIG. 14. Therein the cross-section of the board is formed by parallel U-beams 5, 6 opening against each other and running in the direction of the radius of curvature of the body 1. Each of the beams is formed by flange 7, 8 and the webs 9 connecting them. This forms an accordion profile formed by U-profiles opening against. As is known from statics of structures, a wide web 9 produces a good bending rigidity in the longitudinal direction of the profile. On the other hand, the bending rigidity of the flanges 7, 8 is weak in lateral direction, whereby the webs of the profiles can be moved laterally towards each other and away from each other with small force. Due to the number of parallel profiles the lateral movement allowed by them is summed, whereby the accordion shape produces a good flexibility in the lateral direction of profiles already with a small force. This makes the above-described function of the multi-functional board possible.

A U-profile is an advantageous structure as it allows structurally producing a desired function and a sufficiently smooth surface against the foot and floor without a curve internal coating 1*a* or a curve external coating 1*b*. A coating can naturally be used, if desired, or the spaces between webs 9 can be filled with a flexible material. The cross-section can also be varied by using other cross-sections as well, such as parallel H-forms, a saw tooth form, V-profile, opposing C-profiles or their combinations. The essential feature is that the structure comprises inter-connected load-carrying webs in the direction of the radius of curvature of the body 1, the webs being connected to each other so that they can move laterally (in a direction transverse to their longitudinal axis) in relation to each other. The profile producing the flexibility can also extend to only a part of the width of the body 1.

It will be obvious to one skilled in the art that the invention is not limited to only the alternatives disclosed above, but many variations are possible within the inventive step defined in the appended claims.

We claim:

1. A multi-functional curved board used as a support for legs of a user and for general maintenance of muscle strength, the multi-functional curved board having one or more curved bodies comprising a radius of curvature, a longitudinal axis, and at least one raised foot support, wherein the one or more curved bodies are rigid in a direction of the radius of curvature, supporting at least a weight of the user, and flexible in a direction transverse to the radius of curvature so that the multi-functional curved board can be bent in the direction transverse to the radius of curvature to enable the multi-functional curved board to rotate around the longitudinal axis.

2. The multi-functional curved board according to claim 1, wherein the at least one raised foot support comprises an upper surface on which the user stands.

3. The multi-functional curved board according to claim 1, wherein an upper surface of the at least one raised foot support is convexly curved.

4. The multi-functional curved board according to claim 1, wherein at least one accessory component can be attached to the one or more curved bodies for changing a rocking direction of the one or more curved bodies.

5. The multi-functional curved board according to claim 1, wherein at least one accessory component can be attached to the one or more curved bodies to be used in targeted massage.

6. The multi-functional curved board according to claim 1, wherein the one or more curve bodies comprise a first surface, a second surface opposite the first surface, and end sides, wherein the first surface is convexly curved, the at least one raised foot support is attached to the second surface and adjacent to the end sides of the one or more curved bodies, and the at least one raised foot support is convexly curved relative to the second surface.

7. The multi-functional curved board according to claim 6, wherein the second surface is concavely curved.

8. The multi-functional curved board according to claim 1, wherein a cross-section of the one or more curved bodies is formed by flanges attached to each other in a longitudinal direction at least along a part of the breadth of the one or more curved bodies so that the flanges can move relative to each other in a lateral direction transverse to the longitudinal axis.

9. The multi-functional curved board according to claim 8, wherein the flanges are connected to each other by a web structure having a cross-sectional profile in a shape of an arranged in a center part of the flanges.

10. The multi-functional curved board according to claim 8, wherein the flanges are connected to each other by a web structure having a cross-sectional profile in a shape of a U arranged at edges of the flanges.

11. The multi-functional curved board according to claim 8, wherein the flanges are connected to each other by a web structure having a cross-sectional profile with a saw tooth form.

12. The multi-functional curved board according to claim 8, wherein the flanges are connected to each other by a web structure having a cross-sectional profile comprising at least one of the following forms, a shape of an H arranged in a center part of the flanges, a shape of a U arranged at edges of the flanges, and a saw tooth form.

* * * * *